United States Patent [19]

Persyk

[11] Patent Number: 4,649,269

[45] Date of Patent: Mar. 10, 1987

[54] DYNODES ARRANGEMENT FOR AN ELECTRON MULTIPLIER

[75] Inventor: Dennis E. Persyk, Barrington, Ill.

[73] Assignee: Siemens Gammasonics, Inc., Des Plaines, Ill.

[21] Appl. No.: 587,800

[22] Filed: Mar. 9, 1984

[51] Int. Cl.[4] ..... H01J 40/14

[52] U.S. Cl. ..... 250/207; 313/105 R

[58] Field of Search ..... 250/207, 213 VT; 313/103 R, 103 CM, 104, 105 R, 105 CM, 523, 528, 529, 532–537

[56] References Cited

U.S. PATENT DOCUMENTS

| | | | |
|---|---|---|---|
| 2,234,801 | 3/1941 | Goerlich | 250/166 |
| 2,617,948 | 11/1952 | Kallmann | 250/207 |
| 2,667,599 | 1/1954 | Rajchman | 313/533 |
| 3,959,680 | 5/1976 | Morales | 250/207 |
| 4,367,404 | 1/1983 | Kaye | 313/105 R |

FOREIGN PATENT DOCUMENTS

| | | |
|---|---|---|
| 0066763 | 12/1982 | European Pat. Off. . |
| 977827 | 12/1964 | United Kingdom . |
| 2067281 | 7/1981 | United Kingdom . |

OTHER PUBLICATIONS

Instruments and Experimental Techniques, Mar., Apr. 1968, No. 2, pp. 273–274 "Detector for Measuring the Energy of Ultrarelativistic Particles", by M. Lorkyan.

*Primary Examiner*—David C. Nelms
*Attorney, Agent, or Firm*—Mark H. Jay

[57] ABSTRACT

A dynodes arrangement for an electron multiplier. It comprises a first dynode having a first voltage input; a second dynode having a second voltage input; and a control grid positioned between the first and second dynodes and having a control voltage input separate from the first and second voltage inputs of the first and second dynodes.

8 Claims, 3 Drawing Figures

DYNODES ARRANGEMENT FOR AN ELECTRON MULTIPLIER

BACKGROUND OF THE INVENTION

1. Field of the Invention

The present invention relates to a dynodes arrangement for an electron multiplier. In particular, the invention is utilized in scintillation gamma cameras for nuclear diagnosis purposes.

2. Description of the Prior Art

It is known that the gain of photomultiplier tubes (PMT's), in particular those which are utilized in scintillation gamma cameras, changes with time. Due to this, PMT's have to be retuned from time to time.

The British Patent Application No. 2,067,281 describes a method and circuitry for retuning by means of an automatic gain control (AGC) amplifier.

Further, the British Patent No. 977,827 illustrates a method and circuitry for retuning by modifying the potential of the anode and some of the dynodes, when the total gain of the photomultiplier exceeds a predetermined value, by directly connecting together the anode and a number of dynodes which are closest to the anode.

Finally, the European Patent Application No. 0,066,763 delineates a method and circuitry for retuning by means of varying the potential difference between to neighboring dynodes.

However, it is also possible to retune the gain of a photomultiplier by means of varying the of high voltage.

The aforementioned two methods, namely controlling gain in a photomultiplier tube for retuning by means of varying the interdynode potential differences or by means of changing the high voltage are the easiest methods. However, these methods have also some limitations. These limitations include for example (a) that the peak linear and peak saturated output current from the photomultiplier tube is reduced in the reduced gain state;

(b) that non-linear effects occur as the gain is decreased;

(c) that the transit time of the photomultiplier tube is increased as the gain is decreased; and (d) that the gain changes with the count rate (e.g., increased count-rate-shift effect at decreased gain).

Page 3 of the brochure "Nucleonics Data", issued by Johnston Laboratories, Cockeysville, Md. 21030, Number JLI-605, illustrates a dynodes arrangement wherein a grid is positioned between each two neighboring dynodes. The grid is always electrically connected with one of the two neighboring dynodes.

The copending application Ser. No. 343,207, filed Jan. 27, 1982, by Dennis E. Persyk, entitled "Radiation Detector Assembly for Generating a Two-Dimensional Image" shows a radiation detector having a photocathode, an electron multiplier such as a multichannel plate, and a grid positioned between the photocathode and the electron multiplier. A first electrical field is provided between the photocathode and the grid and a second electrical field is provided between the grid and the electron multiplier; whereby the strength of the second electrical field is larger than the strength of the first electrical field. Due to this the impingement area of a packet of photo electrons on the electron multiplier input is enlarged and thus, simultaneously, the electron density is reduced, which in certain applications is a favorable result.

SUMMARY OF THE INVENTION

1. Objects

It is an object of this invention to provide a dynodes arrangement which allows improved technically simple gain control of an electron multiplier.

It is a further object of this invention to provide an dynode arrangement which allows improved technically simple gain control for a photomultiplier tube in a scintillation gamma camera.

2. Summary

According to this invention, a dynodes arrangement for an electron multiplier is provided which comprises a first dynode having a first voltage input and a second dynode having a second voltage input. The control grid is positioned between the first and second dynodes and has a control voltage input separate from the first and second voltage inputs of the first and second dynodes.

The control grid allows for tuning of the gain of a photomultiplier tube in a technically simple manner, whereby all aforementioned limitations of the prior art do not any longer influence the tuning process.

Advantageously, a dynodes arrangement according to this invention is used in a photomultiplier tube having a photocathode, an anode and the dynodes arrangement between both electrodes.

It is also advantageous to provide a scintillation camera having a scintillation crystal, a number of photo multiplier tubes mounted behind the scintillation crystal and each having a photocathode and an anode with a dynodes arrangement according to this invention. The dynodes arrangement is inserted between both electrodes.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Figure 1:
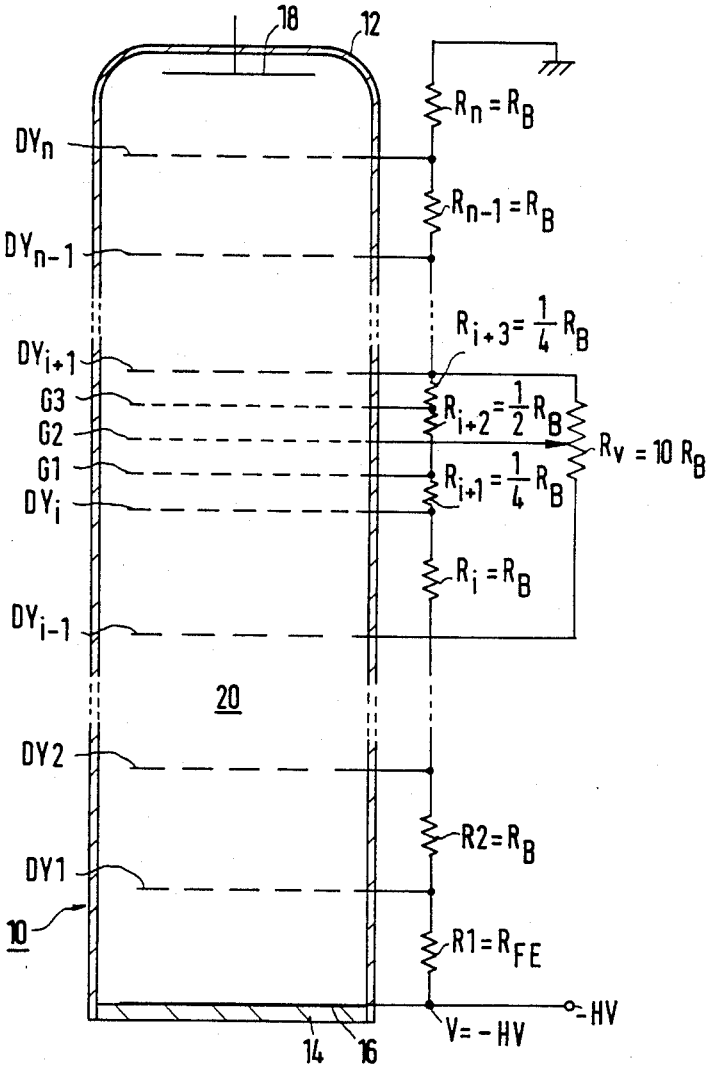
FIG. 1 is a cross section of a photomultiplier tube comprising a dynodes arrangement according to the invention.

In FIG. 1 a photomultiplier tube 10 comprises a housing 12 having an optical input window 14. Behind the input window 14 is positioned a photocathode 16 with the high voltage HV. The anode is generally designated by 18.

Between photocathode 16 and anode 18 is placed a dynodes arrangement 20 according to the invention. The dynodes arrangement 20 comprises a number n (e.g. at least n=4) of dynodes DY1 to DYn.

Interposed between two dynodes, namely $DY_i$ and $DY_{i+1}$, are a first screen grid G1, a control grid G2 and a second screen grid G3. The dynodes DY1 to DYn and the screen grids G1 and G3 between dynodes $DY_i$ and $DY_{i+1}$ are connected by means of an ohmic resistances voltage divider R1 to Rn with a voltage supply source V. The control grid G2 is also connected with the voltage supply source V by means of variable ohmic resistance (potentiometer) $R_v$.

Figure 2:
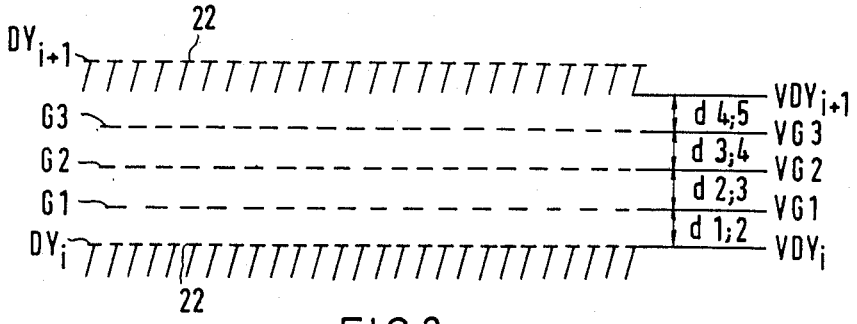
FIG. 2 is an enlargement of a portion of the dynodes arrangement in the photomultiplier tube of FIG. 1 comprising the invention.

According to the enlargement of FIG. 2 the dynodes are so-called venetian-blind dynodes comprising each a transparent grid 22 across its top (electron-impinging surface) as is customary to reduce electric field penetration from the preceding dynode. However, it is understood that instead also other dynode types, such as box-and-grid, circular cage, mesh dynodes, etc., can be utilized in connection with the invention. The spacings between the grids G1, G2, G3 and the neighboring dynodes $DY_i$ and $DY_{i+1}$, are generally designated by d1,2; d2,3; d3,4 and d4,5. They are preferably equispaced (d1,2=d2,3=d3,4=d4,5).

The grids G1, G2 and G4 have an optical transparency of about 98% and similar electron transparency. Photoetched grids would be satisfactory.

The potentials applied to dynodes $DY_i$, $DY_{i+1}$ and the grids G1, G2, G3 are designated $VDY_i$, VG1, VG2, VG3 and $VDY_{i+1}$. Normally $VDY_i - VDY_{i+1} = 100$ volts. The potentials applied to G1 and G3 are given by the following equations:

interdynode potential difference
$$\Delta V = VDY_i - VDY_{i+1}$$

linear potential gradient
$$VG1 = VDY_i - \Delta V(d1,2/d1,5)$$

linear potential gradient
$$VG3 = VDY_i - \Delta V(d1,4/d1,5)$$

Typical potentials are:

$VDY_i = -300$ V $VDY_{i+1} = -200$ V $VG1 = -300\text{ V} - (-100\text{ V} \times \frac{1}{4}) = -275$ V $VG3 = -300\text{ V} - (-100\text{ V} \times \frac{3}{4}) = -225$ V The "normal" potential of G2 in the middle position of variable ohmic resistance $R_v$ is VG2 = −250 V.

Grids G1 and G3, acting as screen grids, do not perturb the electron optics of the interdynode cavity because they are placed at the potential that would normally exist in their respective planes or curved surfaces.

Now gain control is obtained by varying the potential of G2, the control grid, from its "normal" potential of −250 volts to a value of −300 V, or even slightly more negative than $VDY_i$. An electron created on dynode $DY_i$ has a finite initial energy of 5 to 10 electron volts. Thus to obtain maximum cut-off, G2 must be 5 to 10 volts more negative than $DY_i$ to account for initial energy effects.

It is known, that the space-charge limited current density between a planar cathode and anode has a maximum of $$i = \frac{4Eo}{9}\sqrt{\frac{2e}{m}}\ \frac{Vr^{3/2}}{d^2}$$

While in normal PMT operation this equation does not apply, it does become important in prior art gain control schemes. In particular, as the interdynode potential difference is reduced, both the electron ballistics and the linearity of the photomultiplier tubes are modified due to space charge effects. The results are the aforementioned disadvantages of the prior art dynodes arrangements.

In a prior art dynodes arrangement with an interdynodes distance of for example d=4 mm, an interdynode potential reduction of Vr=50 V from the normal interdynode potential difference ΔV=100 V, $Eo = 8.85 \times 10^{-12}$ F/m, $e = 1.6 \times 10^{-19}$ C, and $m = 9.11 \times 10^{-31}$ kg the space-charge limited current density is $i = 5.15$ mA/cm$^2$. The dynamic range is 2:1.

In the dynodes arrangement according to this invention the space-charge region is d2,3=1 mm and Vr=55 V for cut-off. The space-charge limited current density then is $i = 95$ mA/cm$^2$. Thus the invention affords a far greater dynamic range of gain modulation (20:1 or more, contrasted to prior art 2:1 range), plus an 18-fold improvement in space-charge limited (saturation) current.

The invention also decreases the device transit time shift as gain is modulated. In prior art the potential difference between two dynodes is decreased from 100 V to for example 50 V with an accompanying transit time increase from about 3 ns to about 5 ns. According to this invention the drift space over which the gain is controlled is very narrow, so that the change in transmit time is much smaller, e.g., less than 1 ns. This is for example important in fast coincidence circuits of the kind used in positron ECT.

The most novel aspect of this invention (which differentiates it from an ordinary pentode) however, is that the count-rate-shift problem is overcome. Any change in electron space current distribution within a photomultiplier tube causes the gain to vary due to non-uniform dynode surfaces and non-uniform interdynode electron transfer efficiencies. This is most serious in first-pass studies. According to this invention, the current is altered in a narrowly confined region. Due to this the electron trajectories are not altered significantly. Rather, some electrons simply do not transfer from one dynode to another.

Another advantage of a dynodes arrangement according to this invention is that it may be used to gate off a photomultiplier tube without changing gain in the period following gating-on. This is important in certain procedures using short half-life radioisotopes such as $^{95}$Au. It may be desirable to protect the photomultiplier tube from initially-high anode currents until the dose decays to a lesser intensity. With prior art the dynamic range was too small (2:1) and a transistion period of varying gain would accompany a rapid transition from "tube-off" to "tube-on".

The aforedescribed embodiment comprising one control grid and two screen grids is only a preferred embodiment of this invention. Other implementations comprising different number of grids, for example only one control grid or one control grid and one screen grid, are also possible.

Figure 3:
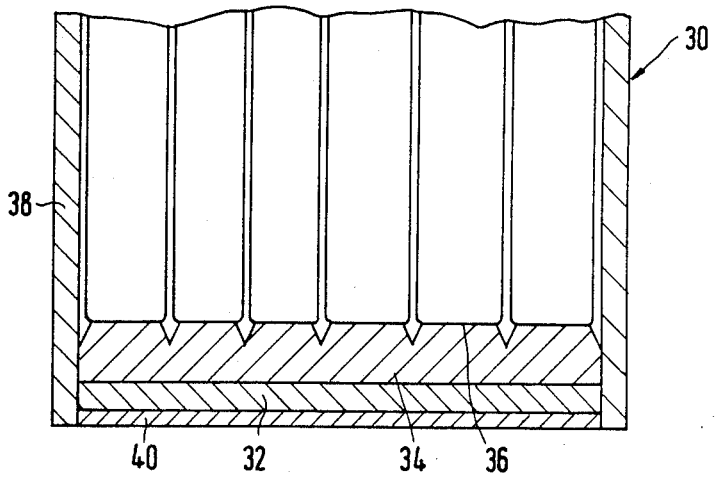
FIG. 3 is a cross section of a scintillation gamma camera including photomultiplier tubes which comprise dynodes arrangements according to the invention.

Photomultiplier tubes comprising a dynodes arrangement according to the invention are particularly implemented in scintillation gamma cameras of the Anger type. Such a scintillation gamma camera is for example illustrated in FIG. 3. The camera 30 comprises a scintillation crystal 32 which is connected with a light conductor 34 having pads 36. On each pad 36 is mounted a photomultiplier tube 10 according to FIG. 1. The camera housing is generally designated by 38. The element 40 is an aluminum cover for the scintillation crystal 32.

The dynodes arrangement of this invention may also be implemented in single tube scintillation cameras.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto. For instance, the grids may have curved rather than plane surfaces.

What is claimed is:

1. A dynodes arrangement for an electron multiplier, comprising:

(a) a first dynode having a first voltage input;

(b) a second dynode having a second voltage input;

(c) a control grid positioned between the first and second dynodes and having a control voltage input separate from the first and second voltage inputs of the first and second dynodes; and (d) at least one screen grid positioned between the first and second dynodes and the control grid, said screen grid having a screen grid voltage input.

2. The dynodes arrangement according to claim 1, further comprising voltage means for supplying biasing voltages to the first and second voltage inputs of the first and second dynodes, the control voltage input of the control grid and the screen grid voltage input of the screen grid, wherein the location of the control grid and the screen grid between the first and second dynodes and the values of the associated grid voltages correspond with each other such that each grid is placed at the potential that would exist at the grid location without the grid.

3. The dynodes arrangement according to claim 2, further comprising means for varying the biasing voltage supplied to the control voltage input.

4. The dynodes arrangement according to claim 1, wherein a first and a second screen grid are positioned between the first and second dynodes, said control grid being placed between the first and the second screen grid.

5. The dynodes arrangement according to claim 1, comprising a plurality of additional dynodes forming together with the first and second dynodes a stack of parallel dynodes.

6. A photomultiplier tube, comprising:

(a) a photocathode;

(b) an anode; and (c) a dynodes arrangement between the photocathode and the anode including (c1) a first dynode having a first voltage input;

(c2) a second dynode having a second voltage input;

(c3) a control grid positioned between the first and second dynodes and having a control voltage input separate from the first and second voltage inputs of the first and second dynodes; and (c4) at least one screen grid positioned between the first and second dynodes and the control grid, said screen grid having a screen grid voltage input.

7. A scintillation gamma camera, comprising:

(a) a scintillation crystal; and (b) at least one photomultiplier tube mounted behind the scintillation crystal, wherein the photomultiplier tube having (b1) a photocathode;

(b2) an anode; and (b3) a dynodes arrangement between the photocathode and the anode including (b31) a first dynode having a first voltage input;

(b32) a second dynode having a second voltage input;

(b33) a control grid positioned between the first and second dynodes and having a control voltage input separate from the first and second voltage inputs of the first and second dynodes; and (b34) at least one screen grid positioned between the first and second dynodes and the control grid, said screen grid having a screen grid voltage input.

8. The dynodes arrangement according to claim 5, wherein an equal number of said additional dynodes are positioned on either side of an area defined by the first and second dynodes and all control and screen grids.

* * * * *